US007025865B2

(12) United States Patent
Ogawa

(10) Patent No.: US 7,025,865 B2
(45) Date of Patent: Apr. 11, 2006

(54) METHOD FOR PRODUCING METAL MASK AND METAL MASK

(75) Inventor: Kiyoshi Ogawa, Chofu (JP)

(73) Assignee: Eastman Kodak Company, Rochester, NY (US)

( * ) Notice: Subject to any disclaimer, the term of this patent is extended or adjusted under 35 U.S.C. 154(b) by 316 days.

(21) Appl. No.: 10/129,877

(22) PCT Filed: Sep. 25, 2001

(86) PCT No.: PCT/JP01/08309

§ 371 (c)(1),
(2), (4) Date: May 10, 2002

(87) PCT Pub. No.: WO02/27073

PCT Pub. Date: Apr. 4, 2002

(65) Prior Publication Data

US 2002/0164534 A1 Nov. 7, 2002

(30) Foreign Application Priority Data

Sep. 26, 2000 (JP) ..... 2000-292914

(51) Int. Cl.

| | |
|---|---|
| ***C25D 1/10*** | (2006.01) |
| ***C25D 1/00*** | (2006.01) |
| ***C25D 1/08*** | (2006.01) |
| ***C25D 1/04*** | (2006.01) |

(52) U.S. Cl. ..... 205/70; 205/67; 205/75; 205/76; 205/78; 205/79

(58) Field of Classification Search ..... 205/67, 205/70, 75, 76, 78, 79
See application file for complete search history.

(56) References Cited

U.S. PATENT DOCUMENTS

| | | | | |
|---|---|---|---|---|
| 3,900,359 | A * | 8/1975 | Bakewell | 156/242 |
| 4,306,925 | A * | 12/1981 | Lebow et al. | 156/150 |
| 5,560,837 | A * | 10/1996 | Trueba | 216/27 |
| 5,686,207 | A * | 11/1997 | Suda et al. | 430/5 |
| 6,179,978 | B1 * | 1/2001 | Hirsh et al. | 204/281 |

FOREIGN PATENT DOCUMENTS

| | | | |
|---|---|---|---|
| JP | 60141887 | A * | 7/1985 |
| JP | 11138827 | A * | 5/1999 |

* cited by examiner

*Primary Examiner*—Edna Wong
(74) *Attorney, Agent, or Firm*—Raymond L. Owens

(57) ABSTRACT

A method for manufacturing a metal mask that facilitates easy dimensional control in the manufacturing process and can manufacture multiple metal masks having high and consistent precision. A Cr film 2 having a mask pattern 2*a* is formed on the surface of a glass plate 1, a dry film 4 is formed on the Cr film 2, the dry film 4 is exposed from the glass plate 1 side with the Cr film 2 as a mask, a mask pattern 4*a* having the same shape as that of the mask pattern 2*a* is formed on the dry film 4, and a metal plating layer 6 is formed on the Cr film 2. The metal plating layer 6 is separated to form a metal mask 7.

8 Claims, 8 Drawing Sheets

METHOD FOR PRODUCING METAL MASK AND METAL MASK

This application is the U.S. National Stage under 35 U.S.C § 371 of International Application PCT/JP01/08309, filed on Sep. 25, 2001.

TECHNICAL FIELD

The present invention relates to a process for manufacturing various types of electronic devices, and more particularly to a preferable method for manufacturing metal masks using a manufacturing method for electroluminescence (EL) devices.

BACKGROUND ART

In order to form vapor deposit films of various metals in the conventional process for manufacturing electroluminescence (EL) elements and other electronic devices, a metal mask is used for forming the desired pattern on the metal films of chromium, stainless steel, and so forth.

The metal mask may be manufactured using the following methods.

(1) On a thin stainless steel sheet or other metal sheet, a resist film is formed. This resist film is exposed to form the desired mask pattern. By using this mask, the thin stainless steel sheet is etched to form a metal mask with the desired pattern.

(2) A resist film is formed on the surface of a stainless steel or other electroconductive material. The resist film is exposed to form the desired mask pattern. Thereafter, by means of an electroplating method, a metal plating layer is formed on the upper surface of the electroconductive material. The metal plating layer is then separated from the upper surface of the electroconductive material to form a metal mask with the desired pattern.

However, for the conventional methods for manufacturing metal masks, the precision of the mask during exposure and the precision of etching have a significant influence on the pattern precision of the metal mask as the final product. Consequently, in the various steps, it is necessary to control the dimensions of the pattern at a high precision. Moreover, in the conventional methods, the metal mask is formed on chromium, stainless steel, or other metals with a high linear expansion coefficient. This resulted in a problem where even a small difference in temperature in the metal material leads to a difference in the dimensional precision between the manufactured metal masks, thereby making it difficult to obtain metal masks having the same dimensional precision.

Also, the metal masks are prone to variations over time in the dimensions of the material that forms the metal mask and in the dimensions of the stainless steel as the feed material for preparing the metal mask. Thus, when many metal masks having high-precision dimensions and small variations in the dimensions are required, a problem was the difficulty in consistently manufacturing metal masks with the same dimensional precision.

For example, when multiple metal masks with the same dimensional precision in the mask pattern are to be manufactured, it is possible to form the metal masks with high precision having little variation at the beginning. However, as the manufacturing progresses over time, variations occur in the dimensions, so that the dimensional precision decreases gradually. Finally, not only does the dimensional precision degrade, but also the variations in the dimensions becomes larger. Consequently, it is difficult to obtain multiple metal masks with high precision and little variation.

The present invention takes into consideration the above-mentioned problems and is intended to provide a method for manufacturing a metal mask wherein control of the dimensions can be performed easily, and multiple high-precision metal masks can be formed with each having dimensions of the same precision.

DISCLOSURE OF INVENTION

In one mode of the present invention, an electroconductive film having a mask pattern is formed on one principle surface of a transparent plate or a transparent film. Then, a photosensitive film is formed on the electroconductive film. Then, with the electroconductive film used as a mask, the photosensitive film is exposed from the side of the transparent plate or transparent film to form a mask pattern in the same shape as that of the mask pattern of the electroconductive film. Then, a metal plating layer is formed on the electroconductive film. The metal plating layer is then separated to form a metal mask.

In another mode of the present invention, a substrate with an electroconductive film formed on one principle surface of a transparent plate or a transparent film is provided. Then, a first resist film is formed on the electroconductive film of the substrate, a first mask pattern is formed on the first resist film, and the electroconductive film is etched with the resist film as a mask. Thereafter, the first resist film is removed, then, a second resist film is formed on the electroconductive film. Then, the second resist film is exposed from the transparent plate or transparent film side with the electroconductive film as a mask to form a second mask pattern on the second resist film. A metal plating layer is then formed by electroplating on the electroconductive film, and the metal plating layer is separated to form a metal mask.

Also, the second resist film is preferably a dry film.

Also, the mask pattern formed on the second resist film preferably includes an opening that narrows as the space on the electroconductive film is farther from the electroconductive film.

Also, in another mode of the present invention, a substrate with an electroconductive film formed on one principle surface of a dielectric plate or a transparent plate or a transparent film is provided. Then, a first resist film is formed on the electroconductive film of the substrate, a first mask pattern is formed on the first resist film, and the electroconductive film is etched with the resist film as a mask. Thereafter, the first resist film is removed, then, a metal plating layer is formed by electroplating on the electroconductive film. The metal plating layer is then separated to form a metal mask having a mask pattern in the same shape as that of the first mask pattern.

Also, the formation of the mask pattern on the first resist film is preferably performed by means of an electron beam exposure method or a laser beam exposure method.

Also, the formation of the mask pattern on the first resist film is preferably performed using a master mask.

Also, in another mode of the present invention, an electroconductive film having a mask pattern is formed on one principle surface of a transparent plate or a transparent film. Then, a metal plating layer is formed on the electroconductive film, and the metal plating layer is separated to form a metal mask having a mask pattern in the same shape as that of the mask pattern of the electroconductive film.

Also, in another mode of the present invention, an electroconductive film having a predetermined mask pattern is formed on one principle surface of a dielectric plate, a metal plating layer is formed on the electroconductive film, and the metal plating layer is separated to form a metal mask having a mask pattern in the same shape as that of the mask pattern of the electroconductive film.

Also, the electroconductive film is preferably a metal film having a principle component of chromium.

Also, the electroconductive film is preferably an ITO film.

Also, another mode of the present invention is a metal mask manufactured by a manufacturing method explained above.

Also, in another mode of the present invention, a metal mask, which is obtained by separating a metal plating layer formed on an electroconductive film having a predetermined mask pattern formed on a dielectric plate, has a tapered opening that widens from the separated surface toward the opposite side with the widest opening on the side of the separated surface.

According to the present invention, an electroconductive film having a mask pattern is formed on one principle surface of a transparent plate or a transparent film. Then, a photosensitive film is formed on the electroconductive film. Then, the photosensitive film is exposed from the side of the transparent plate or transparent film with the electroconductive film as a mask to form on the photosensitive film a mask pattern in the same shape as that of the mask pattern of the electroconductive film. In this way, the photosensitive film can be formed on an area on the transparent plate or transparent film where there is no electroconductive film. Therefore, it is easy to select a material having a low coefficient of thermal expansion, such as glass, for the transparent plate or transparent film so as to eliminate changes over time in the dimensions of the mask pattern. In this way, it is easy to control the dimensions of the mask pattern in the process of manufacturing the metal mask.

Also, with the photosensitive film used as a mask, a metal plating layer is formed on the electroconductive film. By separating the metal plating layer, it is easy to obtain the metal mask having a pattern in the same shape as that of the mask pattern formed on the photosensitive film.

Also, by repeating the step of forming the metal plating layer on the electroconductive film and the step of separating the metal plating layer, it is possible to form multiple high-precision metal masks at the same precision.

Also, according to the present invention, an electroconductive film having a mask pattern is formed on one principle surface of a dielectric plate. Then, a metal plating layer having a mask pattern in the same shape as that of the mask pattern of the electroconductive film can be formed on the electroconductive film. This metal plating layer is then separated to form a metal mask. In this way, a material having a low coefficient of thermal expansion, such as glass or ceramic, can be used for the dielectric plate. It becomes easy to control the dimensions of the mask pattern in the process of manufacturing the metal mask. Also, according to this method, the process is simplified so that the manufacturing cost can be reduced.

Also, because the side of the opening in the metal mask has a tapered shape, the precision of the mask pattern can be improved. In particular, because the metal mask is shaped so that the opening is smallest on the side close to the electroconductive film, the mask pattern becomes precisely the same as the electroconductive film.

Also, by shaping the photosensitive film into a tapered shape, it becomes easy to obtain a metal mask having a tapered opening.

MODE(S) FOR CARRYING OUT THE INVENTION

Embodiments of the manufacturing method for metal masks according to the present invention will be described with reference to the drawings.

[First Embodiment]

The manufacturing method for vapor deposited metal masks for EL devices of the first embodiment according to the present invention will be described with reference to FIG. 1.

Figure 1:
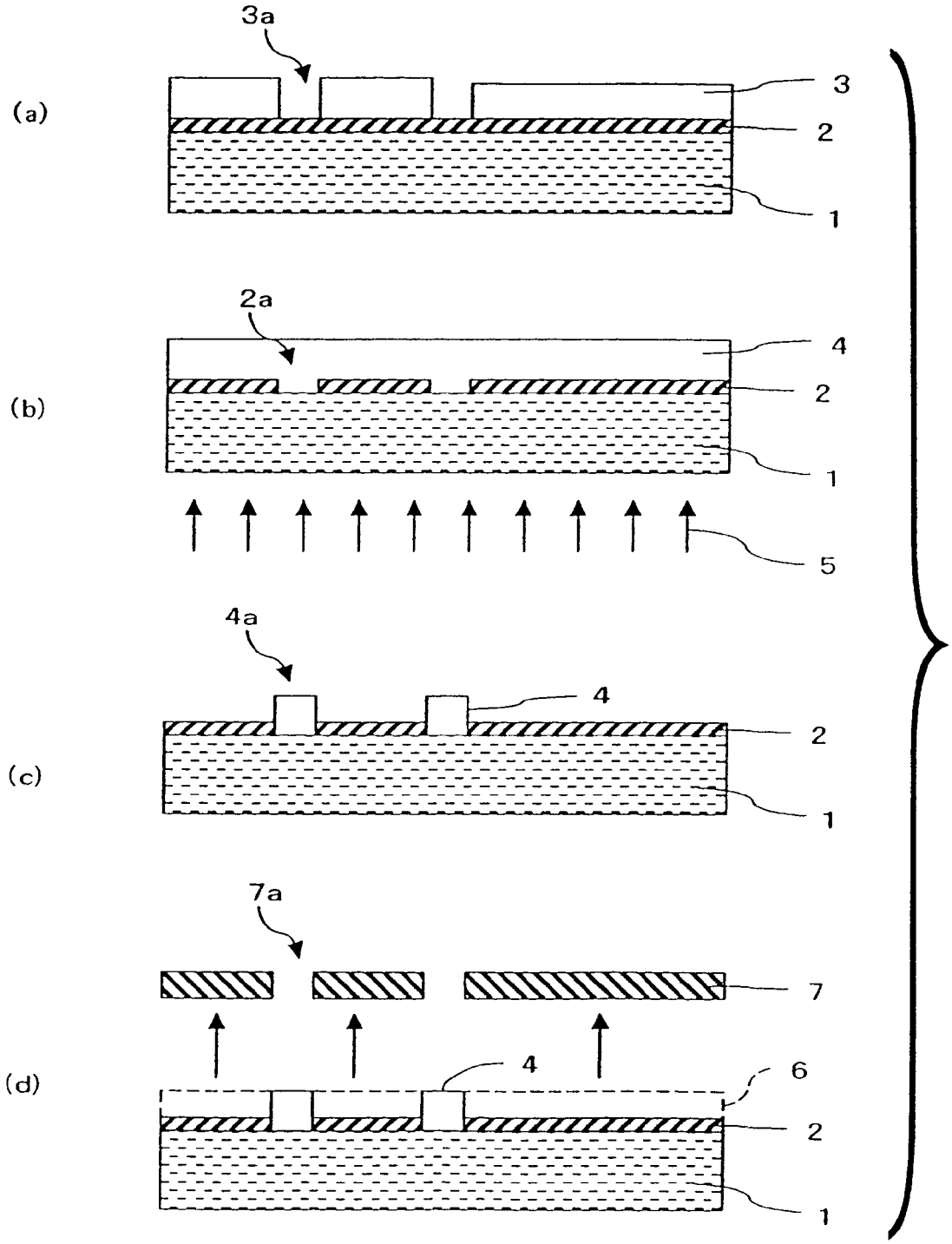
FIG. 1 shows a manufacturing method for a metal mask of the first embodiment according to the present invention.

First, as shown in FIG. 1(*a*), an electroconductive film, for example, a Cr (chromium) film (electroconductive film) 2 with a thickness of 0.1 μm, is formed by means of vapor deposition or sputtering on the surface of a glass plate 1 (one principal surface). Then, by a means of a spin coating method or the like, a photosensitive material (first resist film) 3 with a thickness of preferably about 0.7 μm is formed on the Cr film 2.

Then, by means of an electron beam exposure method, laser beam exposure method, or the like, a mask pattern 3*a* is formed directly on photosensitive material 3. Then, with the photosensitive material 3 used as a mask, Cr film 2 is etched. As shown in FIG. 1(*b*), a mask pattern 2*a* corresponding to and preferably in the same shape as that of the mask pattern 3*a* is formed on the Cr film 2. Thereafter, the photosensitive material 3 is separated or removed. Any commonly known process can be conveniently selected for use in this process. For example, in the above-mentioned electron beam exposure method or the laser beam exposure method, a predetermined area on photosensitive material 3 is scanned by the electron beam or laser beam to expose the area. Furthermore, using a master mask, light may be applied only to a predetermined area to expose the photosensitive material 3.

Then, on the Cr film 2, a preferably 50-μm-thick dry film 4 is laminated (formed). With the Cr film 2 used as a mask, dry film 4 is exposed by a light 5 applied from the glass plate 1 side. In this way, as shown in FIG. 1(*c*), a mask pattern 4*a* in the same shape as that of mask pattern 2*a* is formed on dry film 4.

Then, as shown in FIG. 1(*d*), after pretreatment of Cr film 2, a metal plating layer 6 is formed from Ni, Ni—Co alloy, Ni—W alloy, or the like, by means of electroplating. The thickness of the metal plating layer 6 is approximately 30 μm to 50 μm. Thereafter, the metal plating layer 6 is separated, forming a metal mask 7 having a mask pattern 7*a* in the same shape as that of mask pattern 4*a*.

Also, by repeating the steps shown in FIGS. 1(*c*)–1(*d*), multiple high precision metal masks 7 can be made with each having the same precision.

By means of the method for manufacturing a metal mask in this embodiment, Cr film 2 having mask pattern 2*a* is formed on the surface of glass plate 1. On the Cr film 2, dry film 4 is laminated, and dry film 4 is exposed by light 5 applied from the glass plate 1 side with Cr film 2 as a mask, forming mask pattern 4*a* corresponding to and preferably in the same shape as that of mask pattern 2*a* on dry film 4. Glass plate 1 acts as the base (wall) of Cr film 2, thereby eliminating the variation over time in the dimensions of the mask pattern. As a result, it is easy to control the dimensions of the mask pattern in the manufacturing process of the metal mask.

The coefficient of thermal expansion of the glass plate 1 is 1 μm/° C., which is approximately ⅛ that of stainless steel. By using the glass plate 1, it is possible to suppress deterioration of precision due to heat. Also, although various types of glass materials can be used, soda glass is preferable because of its low cost. On the other hand, although quartz glass is expensive, its advantages include a low coefficient of thermal expansion, excellent light transmission, and scratch resistance.

Also, as metal plating layer 6 is formed by electroplating on Cr film 2, followed by separation of the metal plating layer 6, it is easy to obtain metal mask 7 having mask pattern 7*a* in the same shape as that of mask pattern 4*a*.

By performing this process repeatedly, it is possible to form multiple high-precision metal masks 7 with each having the same precision.

Figure 2:
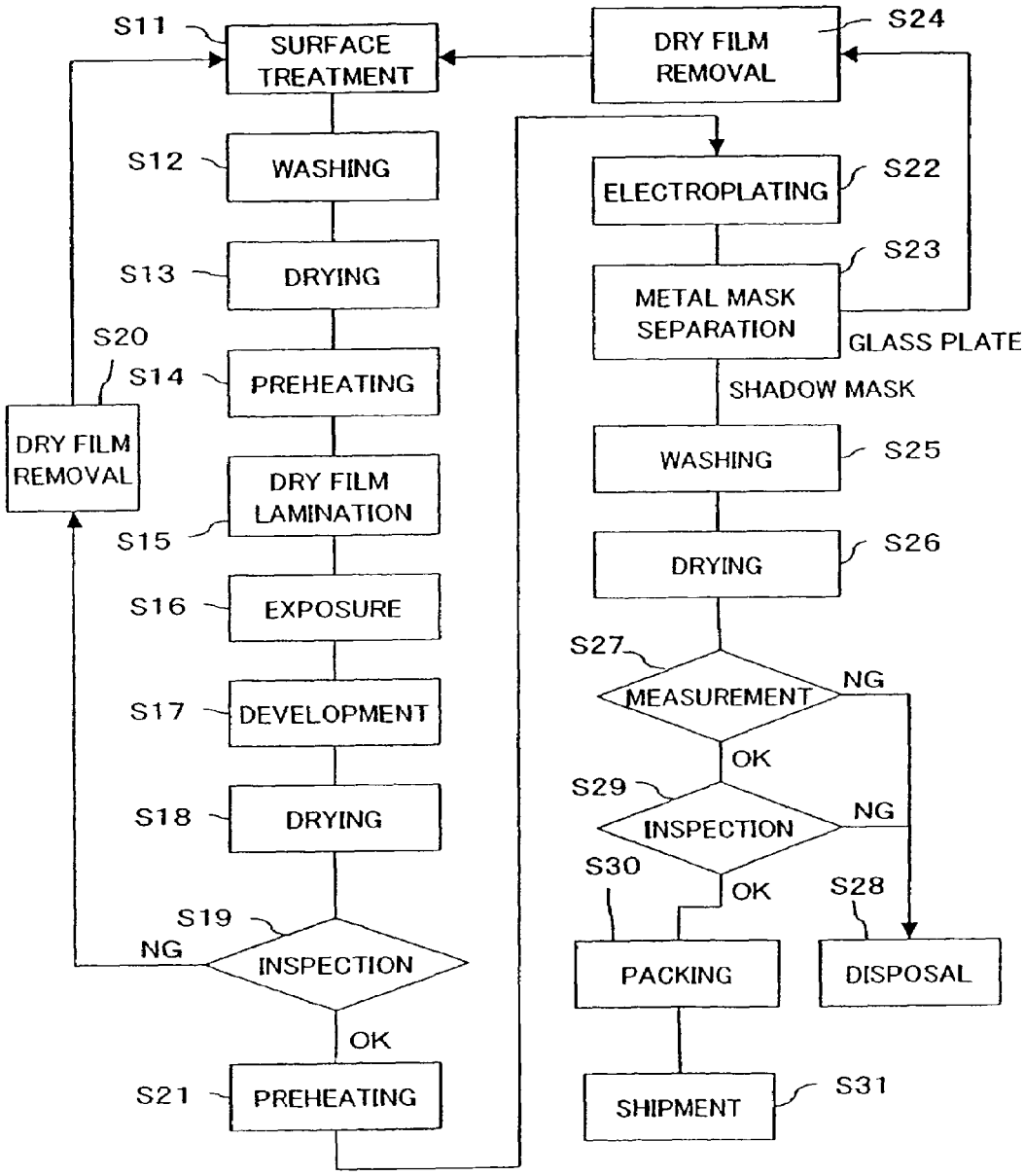
FIG. 2 shows the detailed process of the first embodiment.

Next, the steps for manufacturing the metal mask using the glass plate 1 having Cr film 2 will be described in detail with reference to FIG. 2.

First, for the glass plate 1 on which Cr film 2 is formed, a surface treatment (S11) is performed to remove contamination remaining on the surface, such as residue of the metal plating layer 6. This surface treatment is performed, for example, by placing the surface in contact with a 20% solution of nitric acid ($HNO_3$) for five minutes in a scrubber. Next, the surface is washed in a water shower (S12). In this washing, for example, a 30-second shower is performed twice in a washer. After washing, a drying process (S13) is performed. This drying is performed, for example, by a dryer, by blowing 60° C. air for five minutes. After completion of this drying process, preheating (S14) is performed. This preheating is performed, for example, by maintaining a temperature of 45° C. for five minutes in a chamber.

When washing and preheating are completed in this manner for the glass plate 1 having Cr film 2, dry film (dry film photoresist) 4 is laminated (S15) on the Cr film 2. The lamination of dry film is performed, for example, at 100° C. by a dry film laminator. The thickness of the dry film 4 is approximately 50 μm.

Next, an exposure (S16) is performed from the back side with respect to the dry film 4. Namely, the dry film 4 is exposed with Cr film 2 as a mask by applying a predetermined light (80 mJ energy) from the back side of glass plate 1. Then, the exposed dry film 4 is developed and the unexposed portions are removed (S17). This development is performed, for example, by placing the surface in contact with a 1% solution of sodium carbonate ($Na_2CO_3$) for 40 seconds. By performing development in this manner, the Cr film 2 is exposed and the dry film 4 remains on the other portions. Namely, the Cr film 2 has a thickness of approximately 0.1 μm and the dry film 4 has a thickness of approximately 50 μm so that a wall of the dry film 4 is formed in the periphery of the Cr film 2.

Next, the entire body is dried (S18) using a dryer. Drying is performed, for example, at 40° C. for five minutes. Then, the portion of dry film 4 remaining after drying is checked under a microscope (S19) to determine whether it is appropriate or not. If this check is failed, the dry film 4 is removed (S20) and the process returns to S11.

On the other hand, if the check in S19 is passed, the Cr film 2 is exposed so that after preheating (S21), a DC voltage is applied with Cr film 2 as an electrode to perform electroplating (S22) of metal plating layer 6 onto the Cr film 2. For example, nickel (Ni) is electroplated for four hours in the plating bath.

Since dry film 4 remains on the Cr film 2 except at the upper portion, the wall of the dry film 4 can be used to form the metal plating layer 6 and in a precise shape.

Then, the Ni metal plating layer 6 is separated (S23) as a shadow mask (metal mask) from Cr film 2. The glass plate 1 having Cr film 2 with the metal mask separated has the dry film 4 removed through a chemical washing (S24) and the process returns to S11.

The metal mask obtained in S23 is washed in water (S25) in a washer and dried (S26) with a dryer, then various measurements are conducted (S27) using measuring equipment.

If the measurements in S27 are unsatisfactory, the metal mask is discarded (S28) as it cannot be used. On the other hand, if the result of S27 is satisfactory, an inspection (S29) is made for defects, such as holes, in the metal mask using a color laser microscope. Even if the result of S29 is unsatisfactory, the process transfers to S28 and the metal mask is discarded.

On the other hand, if the result of S29 is satisfactory, the metal mask is packed (S30) and shipped (S31).

When exposing the dry film 4 in S16, it is preferable to form the area on the dry film 4 to be exposed so that it widens gradually by the light applied from the back side of glass plate 1 by moving the glass plate 1. Namely, if the applied light does not comprise parallel rays, by moving the glass plate 1, some of the applied light reaches the rear side of Cr film 2 to widen the exposed area. Also, a similar exposure can be performed by setting the focus of the applied light in the vicinity of Cr film 2 so that the exposed area subsequently widens. Furthermore, on the back side of the glass plate 1, a diffraction plate or a scattering plate for the applied light may be provided to transform the parallel rays to scattered light oriented in various directions for the exposure. This also allows the light passing the opening of Cr film 2 to diverge from the opening and expose the dry film 4.

Figure 3:
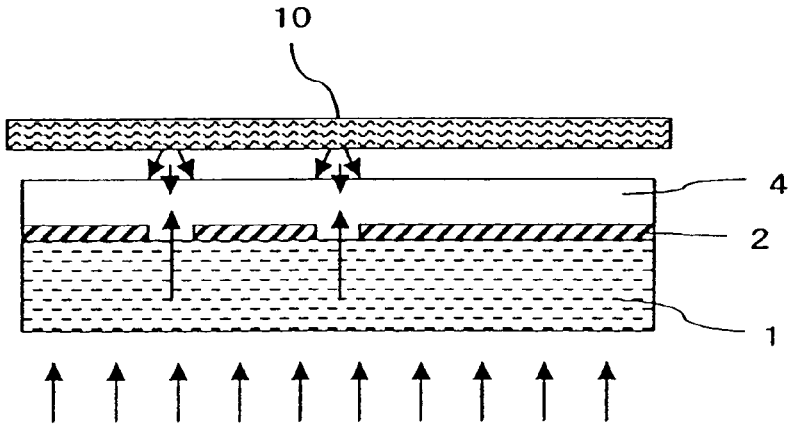
FIG. 3 illustrates a process using a diffusion board.

During exposure, as shown in FIG. 3, it is also preferable to position an irregular reflection plate 10 on the side opposite the glass plate 1 of the dry film 4 so that the reflected light by the irregular reflection plate (diffusion board) 10 shines on the dry film 4. Namely, through this configuration, light initially passes dry film 4, is reflected by the irregular reflection plate 10, and again shines toward the glass plate 1. Therefore, adding a distance from the glass plate 1 widens the exposed area.

Furthermore, by appropriately selecting the etching method for the dry film 4, etching of this type of tapered dry film 4 is possible.

Figure 4:
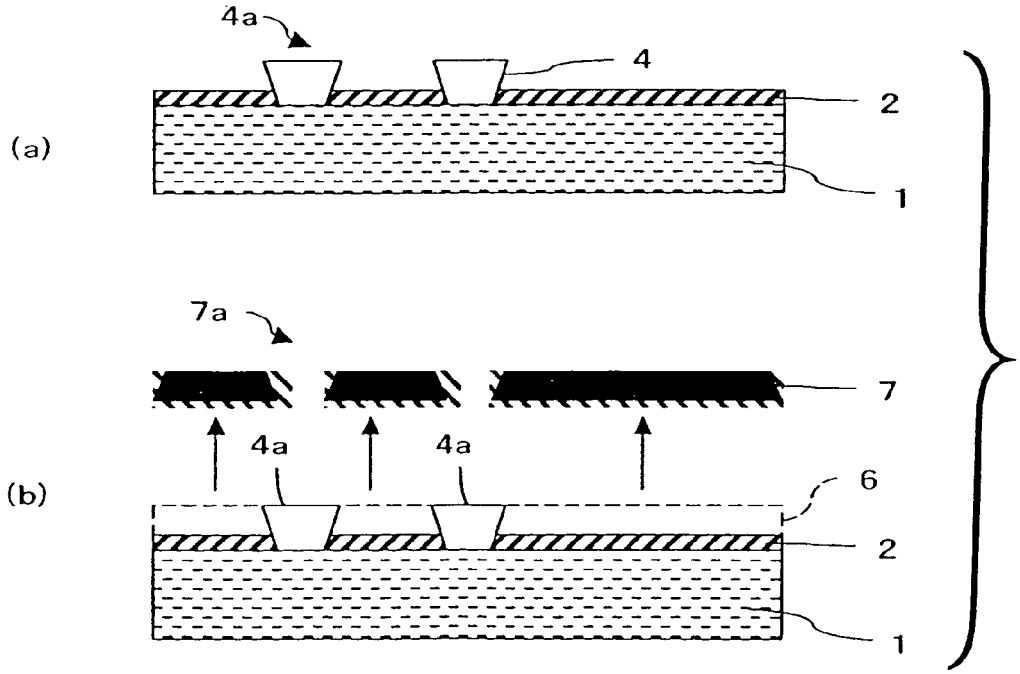
FIG. 4 illustrates a metal mask with tapered openings.

Then, when performed in this manner, the development of S17, as shown in FIG. 4(*a*), enables the dry film 4 having a wider area toward the top to remain. Therefore, as shown in FIG. 4(*b*), the metal plating layer 6 formed by electroplating has tapered sides, which are widest in area on the Cr film 2 and smaller in area toward the top. Thus, the metal mask 7 formed from the separated metal plating layer 6 is shown in FIG. 4(*b*), and the smallest part of the opening has the same shape as that of Cr film 2 from where the opening increases in size in the direction of thickness (toward the top in the figure).

The use of this metal mask defines the smallest part of the opening, which has the same shape as that of the Cr film 2. Therefore, a metal mask having extremely high precision can be obtained.

Furthermore, when this metal mask is used as a vapor deposition mask, an appropriate vapor deposition can be performed. Namely, as EL panels increase in size, the plate for vapor deposition also increases in size. If the opening in the metal mask is straight while performing vapor deposition on such a large plate, a difference in the vapor deposited amount develops between the periphery and the center. However, by tapering the opening of the metal mask, it becomes possible for vapor deposition of material from a diagonal direction at the periphery for a uniform vapor deposited amount. Vapor deposition is performed with the metal mask with the small side of the opening on the plate side. In this way, the area on which vapor deposition is performed can be maintained with accuracy.

Figure 5:
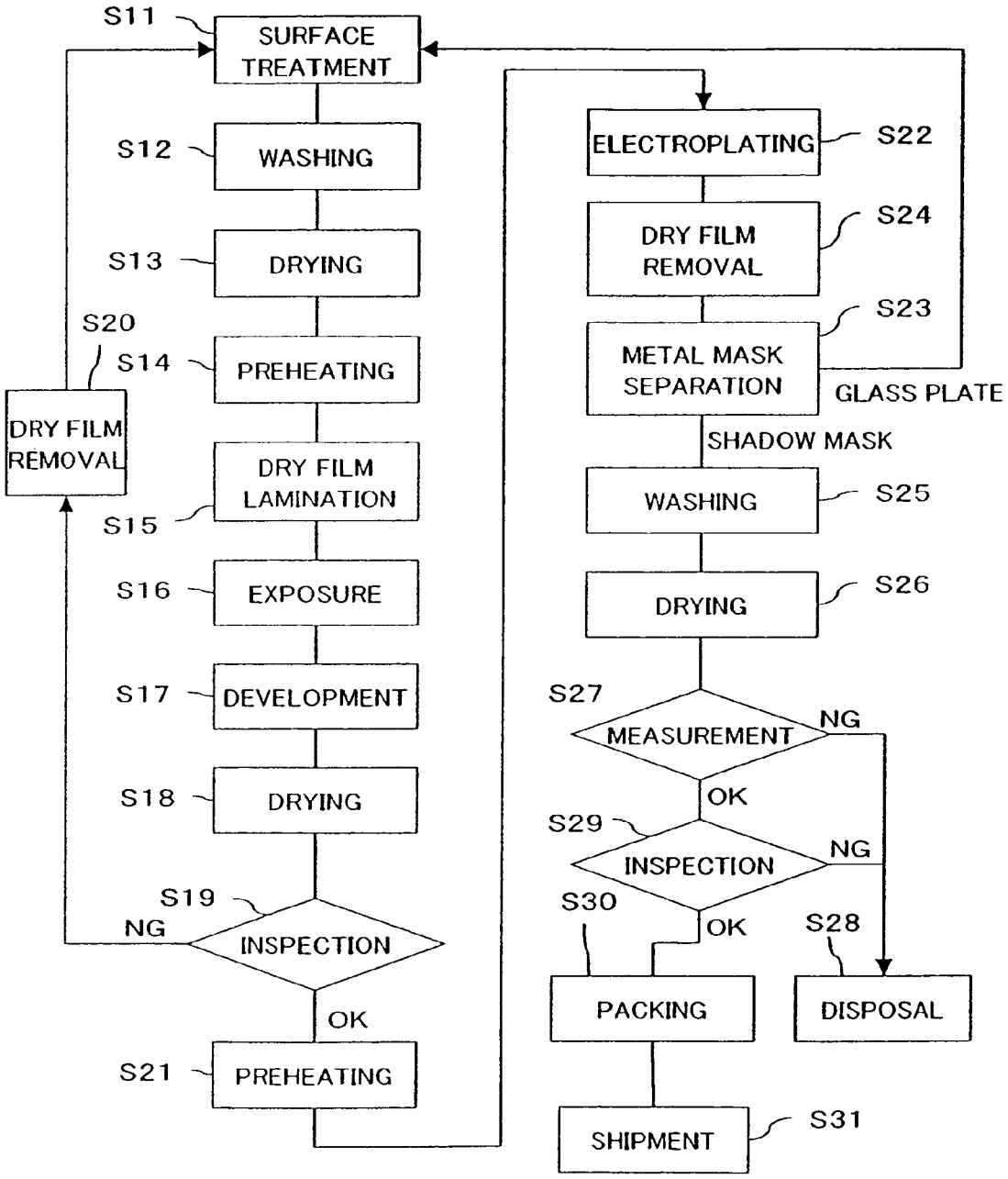
FIG. 5 shows a modified process of the first embodiment.

S24 may be performed before the process of separating the metal mask in S23. Namely, as shown in FIG. 5, after electroplating is performed in S22, the dry film 4 is removed (S24). Then, after the dry film 4 has been removed, the metal mask 7 is separated (S23). Then, the glass plate 1 is returned to the surface treatment of S11. In this case, chemicals that do not affect the metal mask 7 are used in S24.

[Second Embodiment]

A method for manufacturing a metal mask for vapor deposition for EL devices in the second embodiment of the present invention will be described with reference to FIG. 6.

Figure 6:
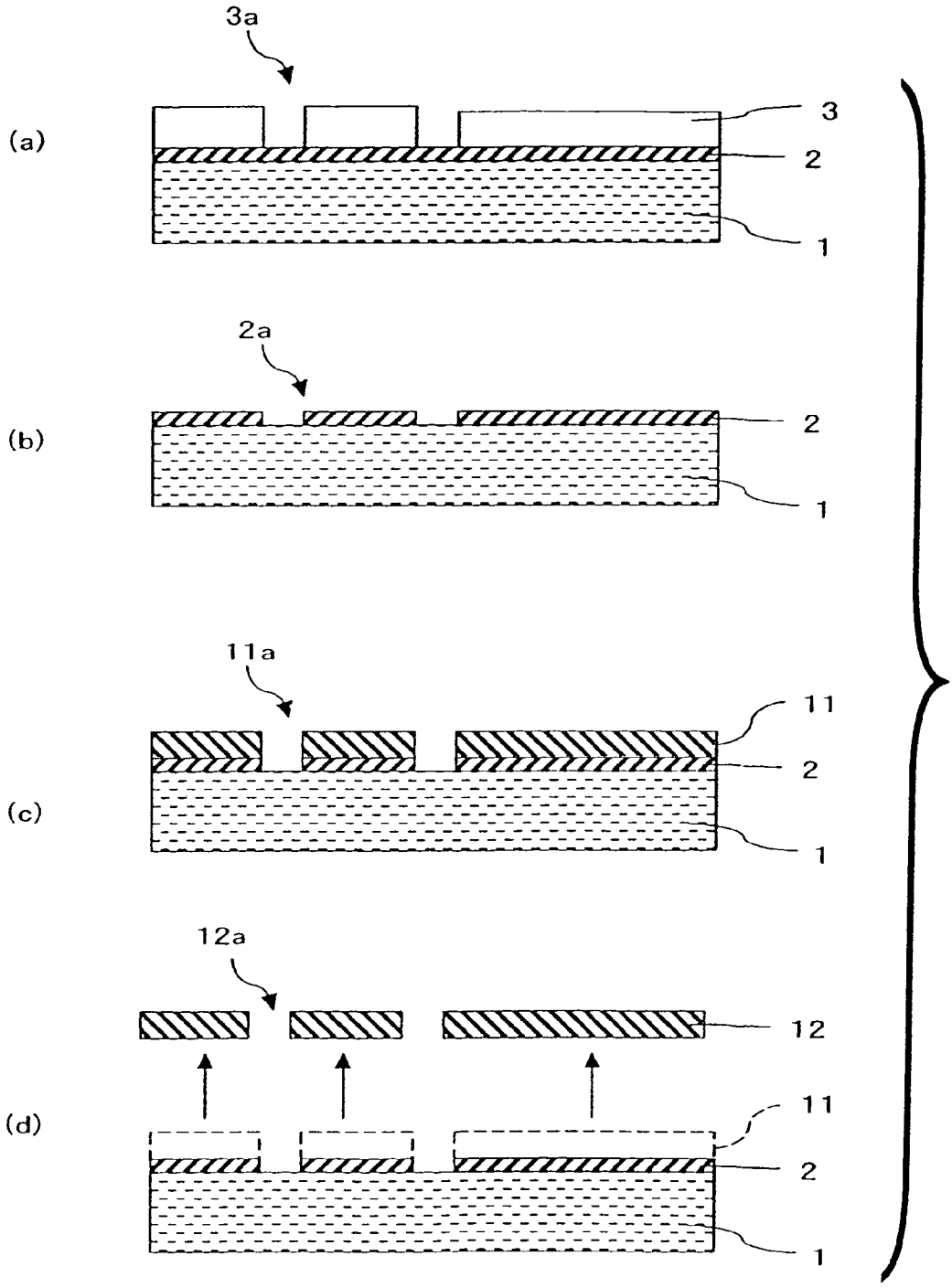
FIG. 6 shows a manufacturing method for a metal mask of the second embodiment according to the present invention.

First, as shown in FIG. 6(*a*), in a manner identical to the manufacturing method of the above-mentioned first embodiment, for example, the photosensitive material (first resist film) 3 with a thickness of 0.7 μm is formed on the Cr film 2 with a thickness of 0.1 μm.

Next, by means of an electron beam exposure method, laser beam exposure method, or the like, mask pattern 3*a* is formed directly on photosensitive material 3. Then, with the photosensitive material 3 used as a mask, Cr 2 film is etched. As shown in FIG. 6(*b*), mask pattern 2*a* corresponding to and preferably in the same shape as that of the mask pattern 3*a* is formed on the Cr film 2. Thereafter, photosensitive material 3 is separated (removed).

Then, as shown in FIG. 6(*c*), after pretreatment of Cr film 2, a metal plating layer 11 is formed on the Cr film 2 by means of electroplating. The metal plating layer 11 is formed from Ni, Ni—Co alloy, Ni—W alloy, or the like, and a mask pattern 11*a* is formed in the same shape as that of the mask pattern 2*a*.

Thereafter, as shown in FIG. 6(*d*), the metal plating layer 11 is separated from Cr film 2 to form a metal mask 12 having a mask pattern 12*a* in the same shape as that of mask pattern 2*a*.

Also, by repeating the steps shown in FIGS. 6(*c*)–6(*d*), multiple high precision metal masks 12 can be manufactured in a simple process with each having the same precision.

By means of the method for manufacturing a metal mask in this embodiment, the metal plating layer 11 is formed by electroplating on the Cr film 2, after which the metal plating layer 11 is separated from the Cr film 2 so as to enable the dimensions of the mask pattern to be easily controlled in the manufacturing process of the metal mask. Furthermore, since the process is simplified, the manufacturing cost can be reduced.

Figure 7:
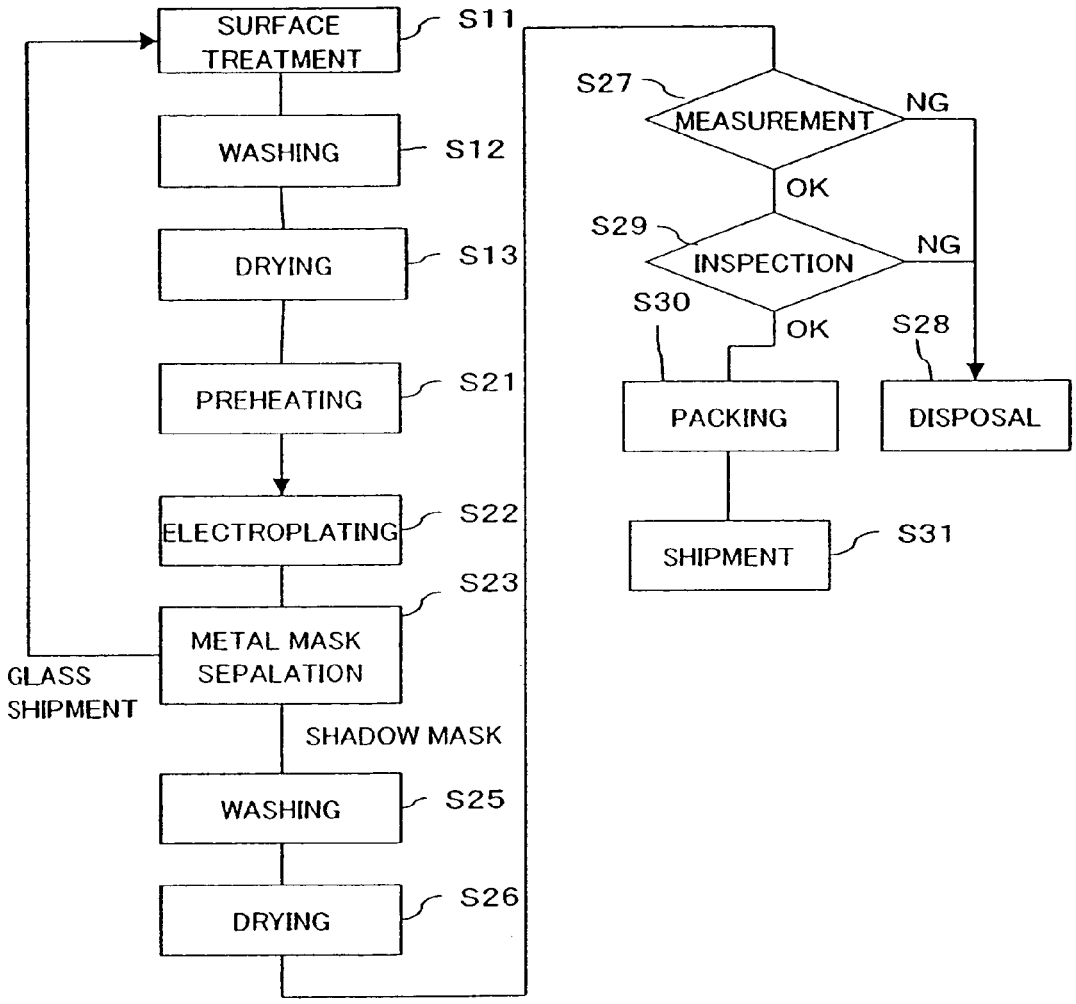
FIG. 7 shows the detailed process of the second embodiment.

In the second embodiment, the procedure for manufacturing the metal mask using the glass plate 1 on which is formed the Cr film 2 is shown in FIG. 7.

As described above, the second embodiment does not have processes for lamination, exposure, development, and so forth for dry film 4. Therefore, compared to FIG. 2, the processes S14–S20 are omitted and the process for S24 does not exist. The remaining processes are performed in general with conditions identical to those of the first embodiment.

Figure 8:
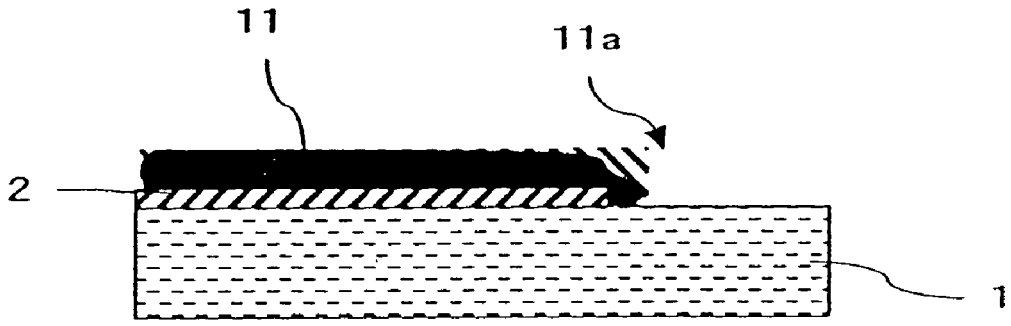
FIG. 8 shows the opening of the metal mask according to the second embodiment.

The electroplating of S22 is performed without dry film 4. Therefore, although the metal plating layer 11 is formed on Cr film 2, it also extends on the side of Cr film 2 as shown in FIG. 8. Therefore, the shape of the metal mask obtained in S23 is not exactly the same as that of the Cr film 2. Therefore, when forming the Cr film 2 in the second embodiment, it is preferable to set the dimensions while taking into consideration that the opening will become smaller from the electroplating.

[Third Embodiment]

In the above-mentioned first embodiment, the mask pattern 4*a* to be the guide for the metal plating layer 6 was formed using the dry film 4. Instead of this, a wet resist can also be used. This process will be described with reference to FIGS. 9(*a*)–9(*d*).

Figure 9:
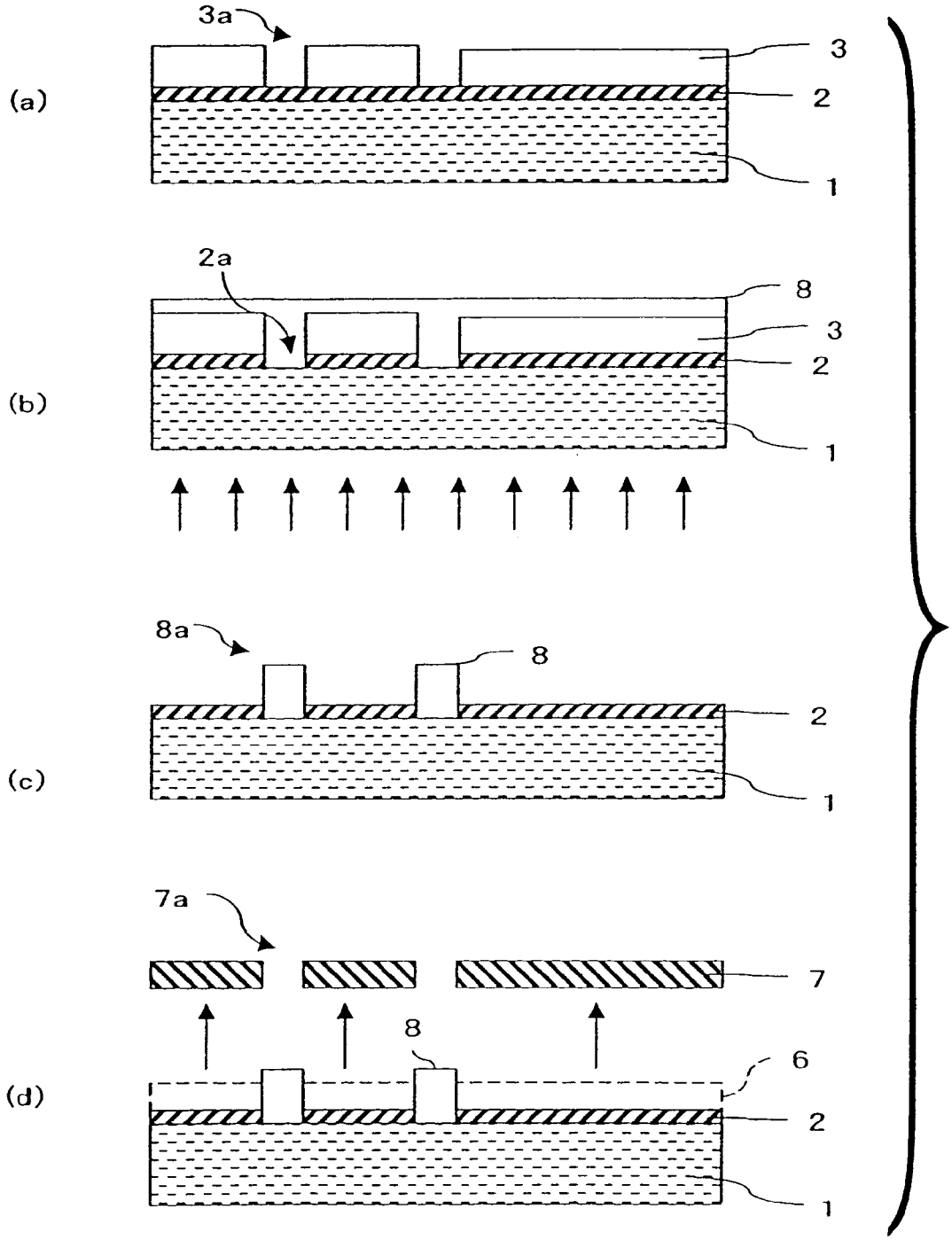
FIG. 9 shows a manufacturing method for a metal mask of the third embodiment.

First, as shown in FIG. 9(*a*), by means of vapor deposition or sputtering, the Cr film 2 with a thickness of 0.1 μm, for example, is formed on the surface of the glass plate 1. Then, by means of a spin coating method or the like, the photosensitive material 3 with a thickness of 0.7 μm, for example, is formed on the Cr film 2.

Then, by means of an electron beam exposure method, laser beam exposure method, or the like, mask pattern 3*a* is directly formed on the photosensitive material 3. Then, the Cr film 2 is etched with the photosensitive material 3 as a mask, and as shown in FIG. 9(*b*), the mask pattern 2*a* having the same shape as that of the mask pattern 3*a* is formed on the Cr film 2.

Thereafter, as shown in FIG. 9(*b*), a second photosensitive material 8 is formed on top of the photosensitive material 3. The second photosensitive material 8 is a liquid and also reaches inside the opening of mask patterns 2*a*, 3*a*. Then, in this state, exposure is performed from the back side of the glass plate 1. In this way, the second photosensitive material 8 is exposed so as to correspond to the mask pattern 2*a* on the Cr film 2.

Then, after exposure is completed, dry etching is performed from the top. At this time, the second photosensitive material 8 is etched at the unexposed portion. Furthermore, the photosensitive material 3 is etched. Therefore, by means of dry etching, as shown in FIG. 9(*c*), the portion exposed on the second photosensitive material forms mask pattern 8*a*.

Next, electroplating is performed to form on the Cr film 2 the metal plating layer 6, which is separated to yield the metal mask 7.

According to this embodiment, the metal mask can be obtained by using a wet photosensitive material without using dry film.

The metal mask obtained in the above-mentioned manner is preferably used as a vapor deposition mask for EL panels. Namely, the EL panel has an EL element at every picture element on the glass plate. The EL element has an electron transport layer, an emissive layer, and a hole transport layer between a cathode and an anode. Furthermore, the active-type EL panel has a thin-film transistor (TFT) corresponding to each EL element to control light emission at each EL element. In the formation of an EL panel having these EL elements, the necessary material layers are laminated in sequence in a predetermined pattern. Then, since a higher definition display is possible with smaller picture elements, the metal mask of the present invention is preferably used as a mask for the material lamination.

In particular, by using a magnetic material for the metal mask, such as nickel, the metal mask can be secured using magnetic force. Thus, the metal mask can be easily secured on the surface to be laminated with materials. Therefore, the metal mask of the present invention is preferably a vapor deposition mask for EL panels.

The various embodiments of the method for manufacturing a metal mask in the present invention have been explained with reference to figures. However, actual configurations are not limited to the various above-mentioned embodiments so that variations and modifications thereto are possible within the spirit and scope of the present invention.

For example, in the method for manufacturing a metal mask in the first and second embodiments, the glass plate 1 was used. However, the glass plate 1 is only for forming a film of Cr or other electroconductive material, and in addition to glass plate 1, it is also possible to use a heat-resistant resin, heat-resistant resin film, or the like. Furthermore, in the second embodiment, exposure is not performed from the back side of glass plate 1. Therefore, it is also possible to use a non-transparent plate instead of the glass plate 1. For example, a ceramic plate or the like may be used.

Also, instead of forming the mask pattern 3*a* directly on the photosensitive material 3 by means of an electron beam exposure method, laser beam exposure method, or the like, a master mask can be used to expose the photosensitive material to form mask pattern 3*a* on the photosensitive material 3.

Also, in the aforementioned embodiments, Cr film 2 and photosensitive material 3 are formed in sequence on the surface of glass plate 1. However, a substrate with Cr film 2 can be first formed on the surface of glass plate 1, and the photosensitive material 3 can be formed on Cr film 2 of this substrate. Also, instead of Cr film 2, the film can be a Cr-based alloy having a principle component of chromium or an ITO film.

Also, dry film 4 is used. However, the dry film 4 may be made of any photosensitive material, such as liquid resist, or other liquid photosensitive resin.

Also, in addition to Ni, Ni—Co alloy, and Ni—W alloy, any type of metal that can be formed by electroplating can be used as the metal for forming metal plating layers 6, 11, such as Ta (tantalum), Mo (molybdenum), W (tungsten), or the like.

Also, electroplating is used in the aforementioned embodiments. However, electroless plating can be used.

Industrial Applicability

As described above, according to the present invention, an electroconductive film having a mask pattern is formed on one principle surface of a transparent plate or a transparent film. Then, a photosensitive film is formed on the electroconductive film. Then, with the electroconductive film used as a mask, the photosensitive film is exposed from the side of the transparent plate or transparent film to form a mask pattern in the same shape as that of the mask pattern on the photosensitive film. In this way, a photosensitive film can be formed on an area on the transparent plate or transparent film where there is no electroconductive film. Therefore, it is easy to select a material having a low coefficient of thermal expansion, such as glass, for the transparent plate or transparent film so as to eliminate changes over time in the dimensions of the mask pattern. In this way, it is easy to control the dimensions of the mask pattern in the process of manufacturing the metal mask.

Also, with the photosensitive film used as a mask, a metal plating layer is formed on the electroconductive film. By separating the metal plating layer, it is easy to obtain the metal mask having a pattern in the same shape as that of the mask pattern formed on the photosensitive film.

Also, by repeating the step of forming the metal plating layer on the electroconductive film and the step of separating the metal plating layer, it is possible to form multiple high-precision metal masks at the same precision.

Also, according to the present invention, an electroconductive film having a mask pattern is formed on one principle surface of a dielectric plate. Then, a metal plating layer having a mask pattern in the same shape as that of the mask pattern can be formed on the electroconductive film. This metal plating layer is then separated to form a metal mask. In this way, a material having a low coefficient of thermal expansion, such as glass or ceramic, can be used for the dielectric plate. It becomes easy to control the dimensions of the mask pattern in the process of manufacturing the metal mask. Also, according to this method, the process is simplified so that the manufacturing cost can be reduced.

Also, because the side of the opening in the metal mask has a tapered shape, the precision of the mask pattern can be improved. In particular, because the metal mask is shaped so that the opening is smallest on the side close to the electroconductive film, the mask pattern becomes precisely the same as the electroconductive film.

Also, by shaping the photosensitive film into a tapered shape, it becomes easy to obtain a metal mask having a tapered opening.

As explained in the above, according to the present invention, dimensional control in the manufacturing process is easy so that multiple high-precision masks can be manufactured at the same precision and the manufacturing cost can be reduced.

What is claimed is:

1. A method for manufacturing a vapor deposition mask suitable for forming vapor deposit films in the manufacture of electronic devices, the method comprising:

(a) forming a photosensitive film on an electroconductive film disposed on a surface of a transparent plate or a transparent film, the electroconductive film having a mask pattern therein;

(b) exposing portions of the photosensitive film through openings in the mask pattern of the electroconductive film;

(c) removing unexposed portions of the photosensitive film such that the exposed portions of the photosensitive film remain in the openings in the mask pattern of the electroconductive film;

(d) forming a metal plating layer on the electroconductive film such that the exposed portions of the photosensitive film create a mask pattern in the metal plating layer; and (e) separating the metal plating layer from the electroconductive film to form the vapor deposition mask, wherein the mask pattern in the vapor deposition mask is suitable for forming vapor deposit films in the manufacture of electronic devices.

2. The method of claim 1, wherein, prior to (a)–(e), the method further comprises:

(f) forming the electroconductive film on the surface of the transparent plate or the transparent film;

(g) forming a resist film on the electroconductive film;

(h) forming a mask pattern on the resist film;

(i) etching the electroconductive film with the resist film as a mask; and (j) removing the resist film.

3. The method of claim 1, wherein the photosensitive film such that the exposed portions of the photosensitive film have a tapered shaped that widens in a direction away from the transparent plate or transparent film.

4. The method of claim 1, further comprising:

(f) positioning an irregular reflector over a surface of the photosensitive film opposite the electroconductive film during exposure of the photosensitive film.

5. The method of claim 4, wherein the irregular reflector reflects exposure light traveling through the photosensitive film back toward the photosensitive film to widen an exposure area toward the surface of the photosensitive film opposite the electroconductive film.

6. The method of claim 1, wherein (a)–(e) are repeatedly performed to produce a plurality of vapor deposition masks using the same electroconductive film and transparent plate or transparent film.

7. The method of claim 6, wherein the exposed portions of the photosensitive film are removed and the electroconductive film is cleaned prior to each repetition of (a)–(e).

8. A method for manufacturing a vapor deposition mask suitable for forming vapor deposit films in the manufacture of electronic devices, the method comprising:

(a) forming an electroconductive film on a surface of a transparent plate or a transparent film;

(b) forming a first resist film on the electroconductive film;

(c) forming a mask pattern on the first resist film;

(d) etching the electroconductive film with the first resist film as a mask to form a mask pattern in the electroconductive film;

(e) forming a second resist film over the first resist film and in openings in the mask pattern of electroconductive film;

(f) exposing portions of the second resist film through the openings in the mask pattern of electroconductive film;

(g) removing the first resist film and unexposed portions of the second resist film such that the exposed portions of the second resist film remain in the openings in the mask pattern of the electroconductive film;

(h) forming a metal plating layer on the electroconductive film such that the exposed portions of the second resist film create a mask pattern in the metal plating layer; and (i) separating the metal plating layer from the electroconductive film to form the vapor deposition mask, wherein the mask pattern in the vapor deposition mask is suitable for forming vapor deposit films in the manufacture of electronic devices.

* * * * *

UNITED STATES PATENT AND TRADEMARK OFFICE

CERTIFICATE OF CORRECTION

PATENT NO. : 7,025,865 B2
APPLICATION NO. : 10/129877
DATED : April 11, 2006
INVENTOR(S) : Kiyoshi Ogawa It is certified that error appears in the above-identified patent and that said Letters Patent is hereby corrected as shown below:

Col. 11, line 11 Insert --is exposed--before "such"

Signed and Sealed this

Fifth Day of December, 2006

JON W. DUDAS
*Director of the United States Patent and Trademark Office*